US008684184B2

(12) United States Patent
Moskow et al.

(10) Patent No.: US 8,684,184 B2
(45) Date of Patent: Apr. 1, 2014

(54) DUAL-SUPPLY PRODUCT CONTAINER

(75) Inventors: Elizabeth Ann Moskow, Boulder, CO (US); Abby Jill Schwalb, Portland, OR (US)

(73) Assignee: Balm Chicky, Inc., Portland, OR (US)

( * ) Notice: Subject to any disclaimer, the term of this patent is extended or adjusted under 35 U.S.C. 154(b) by 0 days.

(21) Appl. No.: 13/550,088

(22) Filed: Jul. 16, 2012

(65) Prior Publication Data

US 2012/0282007 A1 Nov. 8, 2012

Related U.S. Application Data

(63) Continuation of application No. 12/477,649, filed on Jun. 3, 2009, now Pat. No. 8,225,955.

(51) Int. Cl.
*A45D 40/24* (2006.01)
*B65D 25/06* (2006.01)
*B65D 83/00* (2006.01)

(52) U.S. Cl.
CPC ..... *A45D 40/24* (2013.01); *B65D 83/0011* (2013.01); *B65D 25/06* (2013.01)
USPC ..... 206/581; 220/529; 220/524

(58) Field of Classification Search
CPC .. B65D 1/24; B65D 83/0011; B65D 83/0005; A45C 11/008; A45D 40/24
USPC ..... 220/524, 523, 504, 505, 503, 23.6, 220/23.4, 23.86, 23.83, 555, 553, 500, 529, 220/530; 206/581, 223, 216, 823; 401/75, 401/68
IPC ..... B65D 1/24,25/06, 25/04
See application file for complete search history.

(56) References Cited

U.S. PATENT DOCUMENTS

| | | | | | |
|---|---|---|---|---|---|
| 197,760 | A * | 12/1877 | Brewer | 220/504 |
| 2,876,161 | A * | 3/1959 | Gieschi | 424/73 |
| 2,980,246 | A * | 4/1961 | Leshin | 401/75 |
| 3,052,246 | A * | 9/1962 | Beard | 134/155 |
| 3,343,668 | A * | 9/1967 | Politzer | 401/52 |
| 4,444,324 | A * | 4/1984 | Grenell | 215/6 |
| 4,607,756 | A * | 8/1986 | Courtman | 215/6 |
| 5,325,980 | A * | 7/1994 | Grimm et al. | 220/212 |
| 5,957,602 | A * | 9/1999 | Rosenthal | 401/51 |
| 5,988,386 | A * | 11/1999 | Morrow | 206/581 |
| 2005/0218102 | A1 * | 10/2005 | Guilford et al. | 215/11.1 |
| 2009/0223999 | A1 * | 9/2009 | Hill et al. | 222/129 |

* cited by examiner

*Primary Examiner* — Robert J Hicks
(74) *Attorney, Agent, or Firm* — Polsinelli PC

(57) ABSTRACT

A dual-supply container comprises a first compartment having a first opening, the first compartment being configured to contain therein a multiple-use amount of a product; a second compartment having a second opening, the second compartment being configured to contain a limited-use amount of the product; and a removable cover for each compartment that covers the opening of the compartment to seal the product in the compartment.

20 Claims, 5 Drawing Sheets

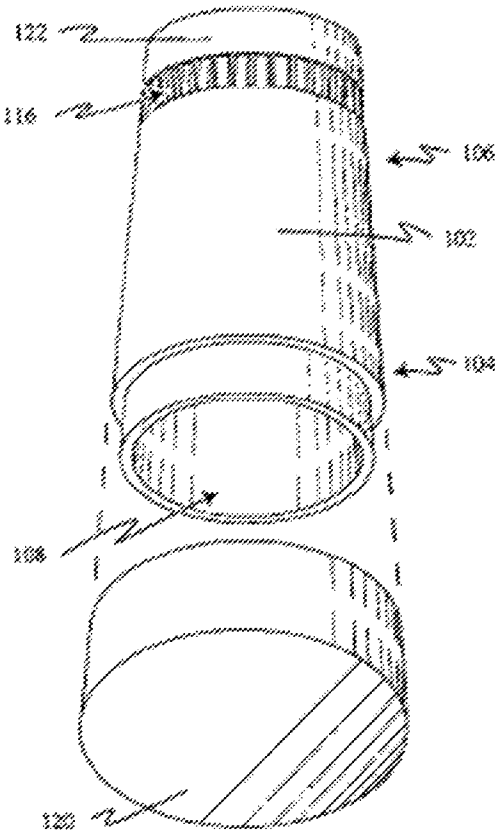
Figure 7
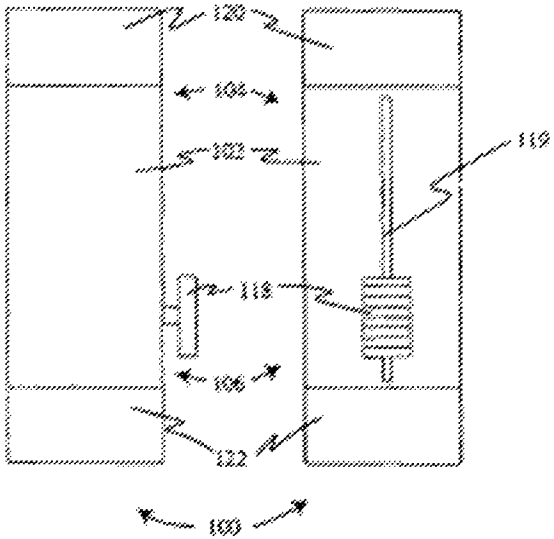
Figure 6B
Figure 6A

DUAL-SUPPLY PRODUCT CONTAINER

CROSS REFERENCE TO RELATED APPLICATIONS

This application is a continuation of and claims the benefit to co-pending U.S. patent application Ser. No. 12/477,649 entitled "Dual-Supply Product Container," filed on Jun. 3, 2009, the disclosure of which is hereby incorporated by reference in its entirety.

TECHNICAL FIELD

The invention relates generally to a container for dispensing direct-application personal care products, such as lip balm, lip gloss, lipstick, stick deodorant, stick antiperspirant or other such products, and more particularly to such containers that provide a secondary source for the product.

BACKGROUND

Many people carry around a container of direct-application personal products, such as lip balm, lip gloss, lipstick, sun screen, skin moisturizer, stick-form deodorants and antiperspirants, and other such products known to those of ordinary skill in the art. For example, frequently containers of lip products are carried around for on-the-go application of the lip products. Other products of a personal nature, such as stick deodorant or antiperspirant are carried to a gym or on a plane for use as needed during natural grooming processes away from home. Often, however, others who are not carrying such products desire or even ask to use some of the product. Because of the personal nature of the product and its contact with a personal body part during application, the owner of the product is hesitant to share it with another due to contamination concerns. Accordingly, there is an absence in the art for a suitable personal care product container that would permit someone to borrow the container and use a portion of the product without contaminating the remainder of the product.

Many types of prior art containers exist for dispensing direct-application personal products. Among these lip care containers are the stick-in-tube type, in which the product is substantially cylindrical and is housed in a container that is basically a hollow tube, often also containing an advancing mechanism. To dispense the product in a stick-arid-tube type container, a user typically would advance the product manually through the tube laterally such that a portion of the product is exposed beyond one end of the tube for application of the product to the user's body; for example, to the lips in the case of lip balm, lip gloss or lipstick and to the underarm in the case of deodorant or antiperspirant. This can be achieved through any number of advancing mechanisms, such as a platform or other device that enables the user to push against the base of the product to move the product along the axis of the tube and out one end of the tube. Examples of sliding type mechanisms include those disclosed in U.S. Pat. No. 5,984,551, to Kinney and U.S. Pat. No. 6,902,333, to Miyagawa, et al, which shows a slot and tongue arrangement, in which a platform against the base of the product includes a tongue that protrudes through a longitudinal slot in the tube such that a user can move the product axially in the tube by sliding the tongue along the slot to expose the end of the product outside the tube.

Another advancing mechanism, the dial-and-screw type mechanism, includes those disclosed in U.S. Pat. No. 2,935,191, to Leshin; U.S. Pat. No. 4,298,036, to Horvath; U.S. Pat. No. 3,589,821, to Barney, et al.; and U.S. Pat. No. 5,733,058, to Hoffmann, each of which is incorporated herein by reference, in which a user can turn a dial, such as a the "fingerwheel" in U.S. Pat. No. 5,733,058, at the base of the tube to advance a platform axially and thereby advance the product seated against the platform axially to expose an end of the product outside the tube. Typically, where a dial is used to advance the product through the tube for application, the dial is located at the opposite end of the tube from the end from which the product projects.

When not in use, a protective cap may be placed over the end of the tube from which the product may project, thereby to cover the otherwise exposed product to prevent contamination of the product or product loss.

Among the stick-in-tube type of lip product containers are certain dual-ended containers, where product may be dispensed through each opposing end of the tube. In such an instance, typically two distinct products, such as two different colors of lipstick, are dispensed in the respective open ends, and often the container is symmetrical with respect to the two ends. This type of container has certain advantages, including the ability for a user to have two types of lipstick or lip gloss in a single container. Such dispensers, therefore, contemplate a situation in which a single user desires two separate options that will be chosen approximately equally as often. In any event, such dispensers are not directed to a situation in which a small reserve of product is maintained for a single or limited use by another without contamination of the primary supply of the personal care product. Moreover, even for those situations for which such dispensers are in fact designed, there are certain disadvantages to such containers, such as excessive or inconvenient length of the tube, non-discrete appearance, and the chance that at least one of the two products would be consumed in its entirety before the other, leading to potential waste, unneeded bulk and loss of the option that, in view of its faster consumption, apparently had been preferred.

Thus, there exists a need in the art for a personal care product dispenser that includes a conveniently located and configured secondary reserve for a relatively small amount of the personal care product that would permit application of the personal care product from the reserve without contamination of the primary supply of the personal care product.

Accordingly, the present new, unique and useful invention seeks to overcome these and other existing problems and needs in the art.

SUMMARY OF THE INVENTION

The present invention is directed to a container for a direct-application personal care product comprises a first compartment having a first opening, the first compartment being configured to contain therein a multiple-use amount of a personal care product for direct application of the product through the first opening to a personal body part; a second compartment having a second opening, the second compartment being configured to contain a limited-use amount of the product for direct application of the product through the second opening to a personal body part; and a removable cover for each compartment that covers the opening of the compartment to seal the product in the compartment.

The present invention is also directed to such container containing a direct-application personal care product.

BRIEF DESCRIPTION OF THE FIGURES

FIG. 6A is a side view of an embodiment of the dual ended product container of the present invention, where the mechanism is a sliding type mechanism, with a smooth side focus on the slide knob.

FIG. 6B is a side view of an embodiment of the dual ended product container of the present invention, where the mechanism is a sliding type mechanism, with a grip side focus on the slide knob.

FIG. 7 is an angled view of an embodiment of the dual ended product container of the present invention, showing additional focus on the proximal end.

Corresponding reference numbers indicate corresponding parts throughout the several views of the drawings.

DETAILED DESCRIPTION OF THE INVENTION

Figure 1:
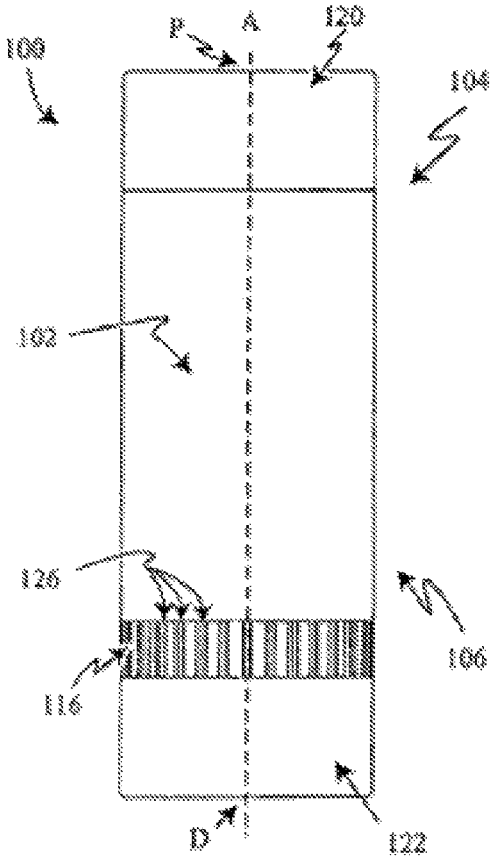
FIG. 1 is a side view of an embodiment of the dual ended product container of the present invention, where the mechanism is a dial-and-screw type mechanism.

The present invention is a container for dispensing a direct-application personal care product. The preferred container is particularly well-suited to personal care products, such as lip balm, lip gloss, lipstick, sun screen, skin moisturizer, stick deodorant, and stick antiperspirant, that are designed for repeated direct application to a personal body part, especially when each application raises the concern that the direct application of the product to the personal body part may contaminate the portion of the product remaining in the container after the application. Although the personal body part may be a finger, such as when the user dabs the product with a finger for application to another of the user's body part, such as the lips, more commonly it is contemplated that the personal body part would be one typically considered of a more personal nature in terms of hygiene, such as the lips or underarms.

The container of the present invention provides at least two separate and distinct supplies of a personal care product—a primary supply and a secondary supply. As will be understood by the reference to two supplies of a product, both supplies are preferably of the same product to permit hygienic sharing of a single product, as opposed to, for example, two colors of lipstick, which offers a choice of alternative products. The primary supply, also referred to as the primary product, is intended for multiple uses by the owner of the container. As used herein, "a multiple-use amount of" the product means an amount of product sufficient for at least about ten uses. More typically, sufficient product is provided for at least about twenty uses. It will be readily appreciated by those of ordinary skill in the art that the amount sufficient for multiple uses will depend on the particular product and such ordinarily skilled artisans likewise will readily recognize what amounts for the particular product would be sufficient for multiple use of the product. By way of illustration, it may be that if the product is lip balm, the multiple-use amount is at least about 2 ml, such as at least about 5 ml, of the product.

The secondary supply of product is an auxiliary supply of the product intended for a very limited use of the product, such as one or two applications. It again will be readily appreciated by those of ordinary skill in the art that the amount for such limited use will depend on the particular product and such ordinarily skilled artisans likewise will readily recognize what amounts for the particular product would be sufficient for such use. Generally, the secondary supply is at most about 0.5 ml, which is referred to herein as a "limited-use amount." By way of example, for some products, the secondary supply would be at most about 0.25 ml, and particularly at most about 0.1 ml of the product. The amount of secondary supply, of course, is greater than zero, and typically would be at least about 0.01 ml. In a particularly preferred form, the secondary supply is enough only for minor use of the product by someone other than the owner of the container. By "minor use" what is meant is one to three uses, so a "minor-use amount of" the product is an amount that is enough only for such minor use. In any event, however, by definition, the multiple-use amount is at least about five times the limited-use amount by volume and at least about five times the minor-use amount by volume. Preferably, however, the multiple-use amount is at least about ten times the limited-use amount and minor-use amount by volume.

A container of the present invention, therefore, comprises a first compartment having a first opening, the first compartment being configured to hold therein a multiple-use amount of a personal care product for direct application of the product through the first opening to a personal body part, and a second compartment having a second opening wherein the second compartment is configured to contain a minor-use amount of the product for direct application of the product through the second opening to a personal body part. The container further comprises a removable cover for each compartment to cover the opening of the compartment to seal the product in the compartment.

In certain embodiments, the container further comprises a mechanism for dispensing the primary product or, at least, advancing the product in the container for dispensing the product, especially as the product is depleted through repeated use. Because the secondary supply of product is generally enough only for one or two uses, there may be no need for such a mechanism with respect to the secondary product. A variety of suitable mechanisms are known to those of ordinary skill in the art, such as, for example, a dial-and-screw type mechanism or a sliding type mechanism as described in the patents noted in the Background section of this specification. While it is believed that any suitable mechanisms may be used in combination with the present invention, preferred mechanisms are dial-and-screw type and sliding type.

Referring now to the drawings, FIG. 1 illustrates an embodiment of a container 100 for dispensing a direct-application personal care product. As illustrated in FIG. 1, the container 100 is generally cylindrical about an axis A having proximal and distal ends P and D, respectively, relative to the an opening in the container for dispensing the product therein, as will be discussed more fully below. As further illustrated in FIGS. 1 and 2, the container comprises an elongate member 102, a proximal end 104, a distal end 106, a first or primary compartment 108, and a secondary or auxiliary compartment 110. The proximal and distal ends 104, 106 of the container 100, and the primary and distal ends of the axis P and D are regions of the container and axis, respectively, rather than specific points on or in the container or axis.

Figure 2:
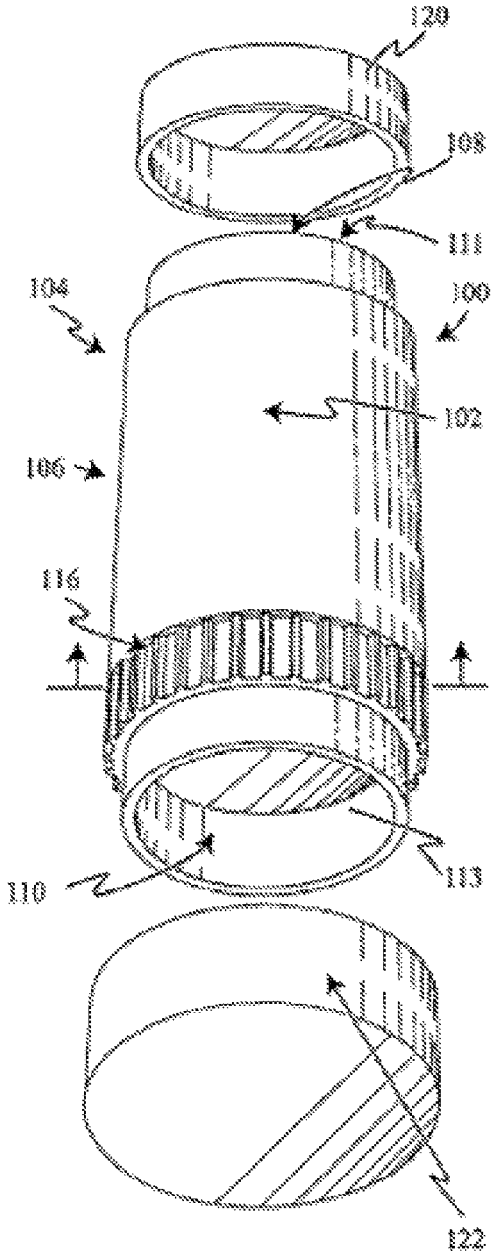
FIG. 2 is an angled view of an embodiment of the dual ended product container of the present invention, showing additional focus on the distal end, where the mechanism is a dial-and-screw type mechanism.
Figure 3:
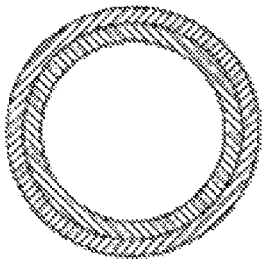
FIG. 3 is an end view of the embodiment in FIG. 2, along line 3-3.

The first compartment 108 is a first generally tubular housing oriented about the axis A at the proximal end P of the axis and the second compartment 110 is a second generally tubular housing oriented about the axis A at the distal end D of the axis. The first and second compartments 108, 110 define internal volumes such that the internal volume defined by first compartment 108 is greater than the internal volume of the second compartment 110. As shown in FIGS. 1 and 2, the first compartment 108 is located entirely within the elongate member 102.

In a preferred embodiment, as can be seen in FIGS. 2 and 7, the first compartment and the second compartment are arranged axially, and the first compartment 108 has an opening 111 at the proximal end 104 to permit access to the contents of the first compartment, and the second compartment 110 has an opening 113 at the distal end 106 such that the openings 111, 113 face outwardly and opposite each other.

As noted, preferably, the container 100 further comprises covers for the openings. Illustrative of such covers are primary cap 120 and a secondary cap 122, where the primary cap covers and encloses the opening of the first compartment 106, and the secondary cap covers and encloses the opening of the second compartment 110 such as to seal the primary and secondary supplies of the product in their respective compartments. It will be recognized that while it is preferred that covers provide an airtight seal to protect the supplies of the product from deterioration resulting from exposure to air, in its broadest embodiment, the seals provided by the covers of this invention need not be airtight, but only shield the product from unintended contact with external surfaces such as skin or clothing.

Figure 8B:
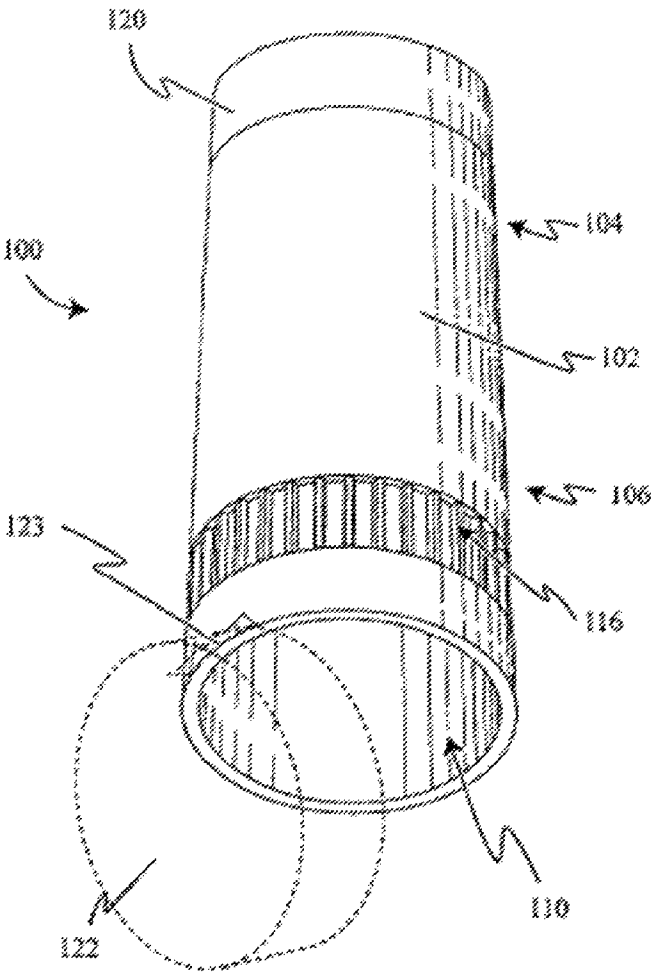
FIG. 8B is an angled view of an embodiment of the dual ended product container of the present invention, showing additional focus on the distal end, this embodiment including a secondary cap that is a flip top type cap, this view showing the cap in a open position with dashed lines to indicate the cap and show detail of the secondary compartment.
Figure 8A:
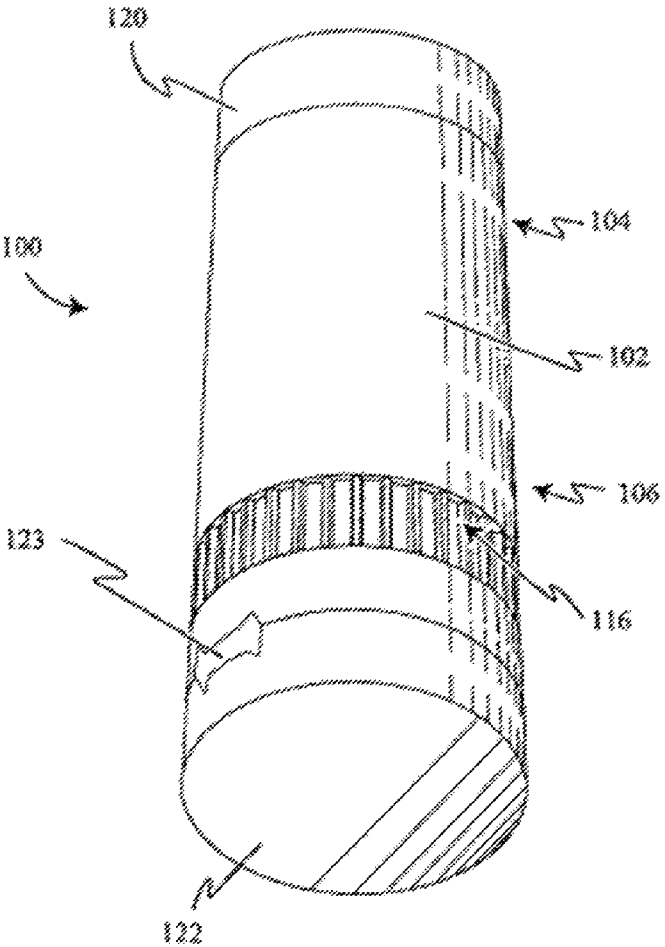
FIG. 8A is an angled view of an embodiment of the dual ended product container of the present invention, showing additional focus on the distal end, this, embodiment including a secondary cap that is a flip top type cap, this view showing the cap in a closed position.

The covers are "removable" in that they may be removed from the opening to reveal the supply of product underneath. Although removable from the opening, the covers may still be attached to the compartment such as by a hinge as shown in FIGS. 8A and 8B, which show a cap 122 connected to compartment 110 by way of hinge 123. Accordingly, multiple embodiments of a secondary cap are envisioned, including both a removable cap, such as that seen in FIG. 7, as well as a flip top type cap, such as that seen in FIGS. 8A and 8B, in a closed and open position, respectively. Depending on the needs of the manufacturer, a flip top type cap may be preferable to alternatives in that such a cap may permit a greater diameter of the opening of the secondary compartment, as can be seen in comparing FIG. 2 and FIG. 8B.

Figure 9:
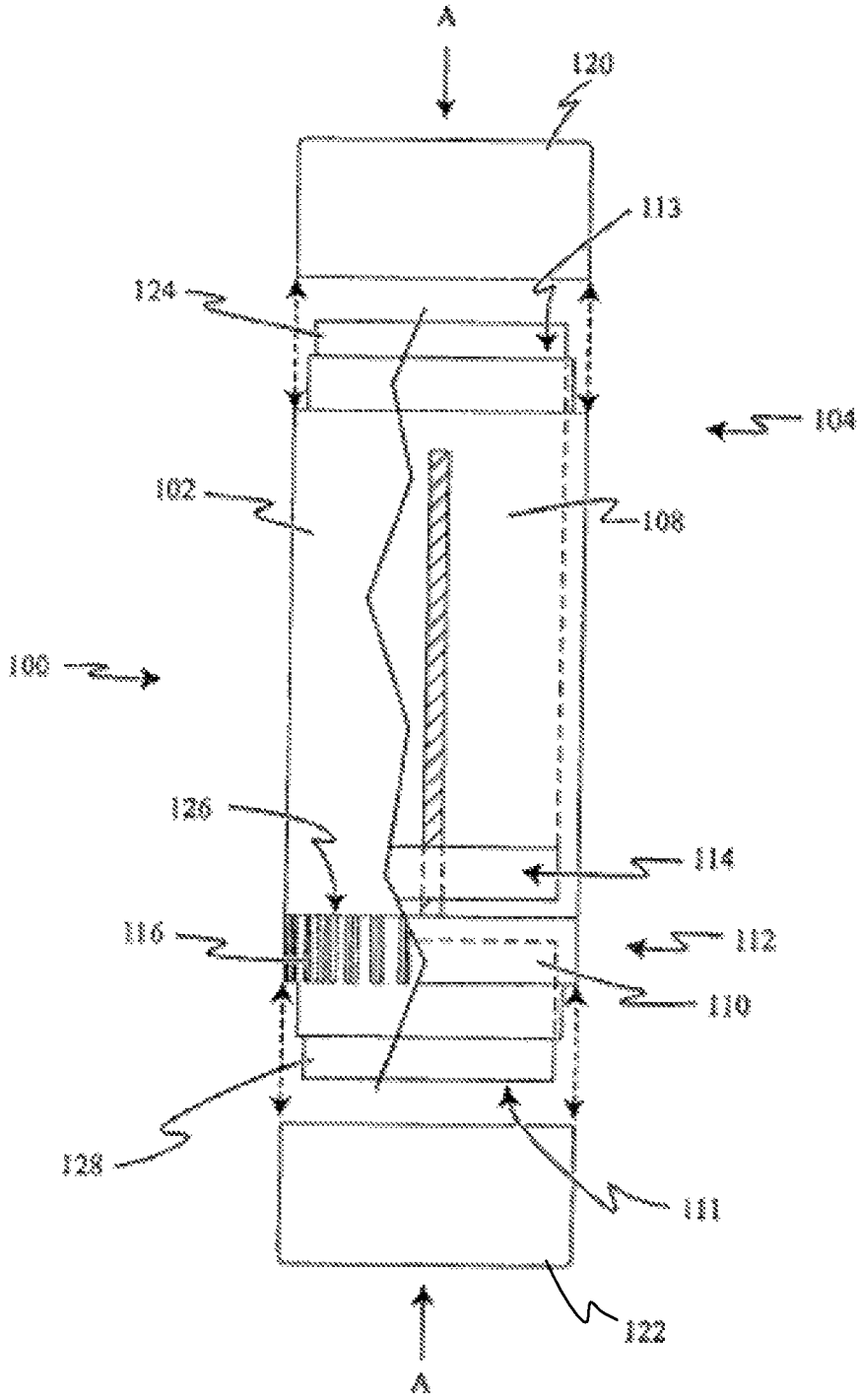
FIG. 9 is a side partial cut away view of an embodiment of the dual ended product container of the present invention, this embodiment comprising a dial and screw type mechanism, the dashed lines in this figure representing the primary and secondary products, as further detailed herein.

As further shown in FIG. 9, the multiple-use amount of a supply of product 124 may be contained within the first compartment 106 such that the supply of product 124 is seated on a platform 114. Where a secondary supply of product 128 is present, it is contained in the second compartment 110. Although the supplies of product are referred to in this and other embodiments as being "contained" in their respective compartments, it will be appreciated that the supplies of product need not be wholly within the compartment, especially when the supplies of product are being applied to a body part, in which case some embodiments contemplate that an end of the supply of product will protrude from the compartment for dispensing product on the body part. Despite the protrusion of a portion of a supply of product from its compartment, such supply is still referred to herein as "contained" in the compartment.

In an embodiment, as seen in FIG. 9, the container 100 further comprises a mechanism 112 for moving a platform 114 axially in the first compartment 106 by rotating dial 116 relative to the axis A. The mechanism for advancing the supply of product in this embodiment, which incorporates a dial-and-screw arrangement, is described in some of the patents, such as U.S. Pat. No. 5,733,058, cited and incorporated herein by reference above. A side and a perspective view of an embodiment of a container with such a dial-and-screw type mechanism may be seen, for example, in FIGS. 1 and 2, respectively. Multiple side views of an alternative embodiment of a container with a sliding type mechanism may be seen, for example, in FIGS. 6A and 6B.

In an embodiment, where a dial-and-screw type mechanism is present, the mechanism the dial 116 may be located at the distal end of the first compartment 108, opposite the first opening relative to the first compartment at or near the base thereof. The dial 116 may include ridging 126 to assist the user in gripping and turning the dial, where the ridging may be substantially parallel to axis A. In operation, the mechanism exposes or retracts the primary product 124 relative to the opening of the first compartment 106 as a user turns the dial 116 clockwise or counterclockwise, wherein turning the dial in one direction causes the primary product 124, seated on the platform 114, to be exposed and turning the dial in the other direction causes the primary product to retract within the compartment. As the end of the primary product 124 reaches the opening at the end of the first compartment 106 on the proximal end 104, the exterior end of the primary product is exposed for application by the user, and may subsequently be retracted for storage. After such retraction, the primary cap 120, when present, may be placed over the opening of the first compartment 106 to prevent contamination of the primary product 124.

In such an embodiment, it will be noted that the dial in certain commercial forms of lip balm containers that incorporate a dial-and-screw mechanism is a thin disk with peripheral wall extending therefrom, with a cavity formed by the base and peripheral wall. This configuration of the dial may form the second compartment, in which case the cavity in the dial would contain the limited-use supply of the product and the container would further comprise a removable cover to conceal the product in the cavity of the dial. In this embodiment, it will be noted, that the container may be of the same dimensions of the prior art container, yet have the added advantages associated with a secondary supply of product that may be shared hygienically with another.

In an embodiment wherein a sliding type mechanism is present, the mechanism preferably comprises a slide knob 118, where the slide knob resides on the exterior of the elongate member 102 and is in communication with the platform 114 such that when a user moves the slide knob longitudinally along the elongate member, the platform moves in the either same or opposite direction within the first compartment 106, depending on the structure of the mechanism, which in turn would cause the primary product 124, resting on the platform 114, to be exposed or to retract. In a simple configuration, the slide knob is connected to the platform 114 by a stem that extends from the slide knob 118, through the longitudinal slot 119, to the platform 114. Similarly to the embodiment comprising the dial-and-screw type mechanism, in this embodiment, as the end of the primary product 124 reaches the proximal end of the first compartment 106, an end of the supply of product contained in the compartment is exposed for application by the user, and may be retracted back into the compartment subsequently for storage. After such retraction, the primary cap 120, when present, may be placed over the opening of the first compartment 106 to prevent contamination of the supply of product 124.

The second compartment 110 is preferably located on the distal end 106 of the container, such that the compartments are oriented axially with respect to one another, but in opposite orientation in that they each comprise a base with a wall extending therefrom to form a container with an opening opposite the base, and the compartments are oriented with there bases toward each other and the openings face outwardly in opposite directions.

In a preferred embodiment, the second compartment 110 does not include a mechanism to advance the supply of product therein outwardly of the compartment, but rather the supply of product in that compartment remains stationary relative to the second compartment. In this manner, a user may access the supply of product 128 in the second compartment 110 merely by removing the secondary cap 122. Thus, the supply of product 124 in the first compartment 108 may be one suitable for lateral dispensing in stick form, for example directly onto a user's lips, while the supply of product 128 in the second compartment 110 may be one suitable for either application, for example directly onto a user's lips or alternatively one suitable for removal by a user's finger and then applied via finger onto a user's lips.

Figure 4:
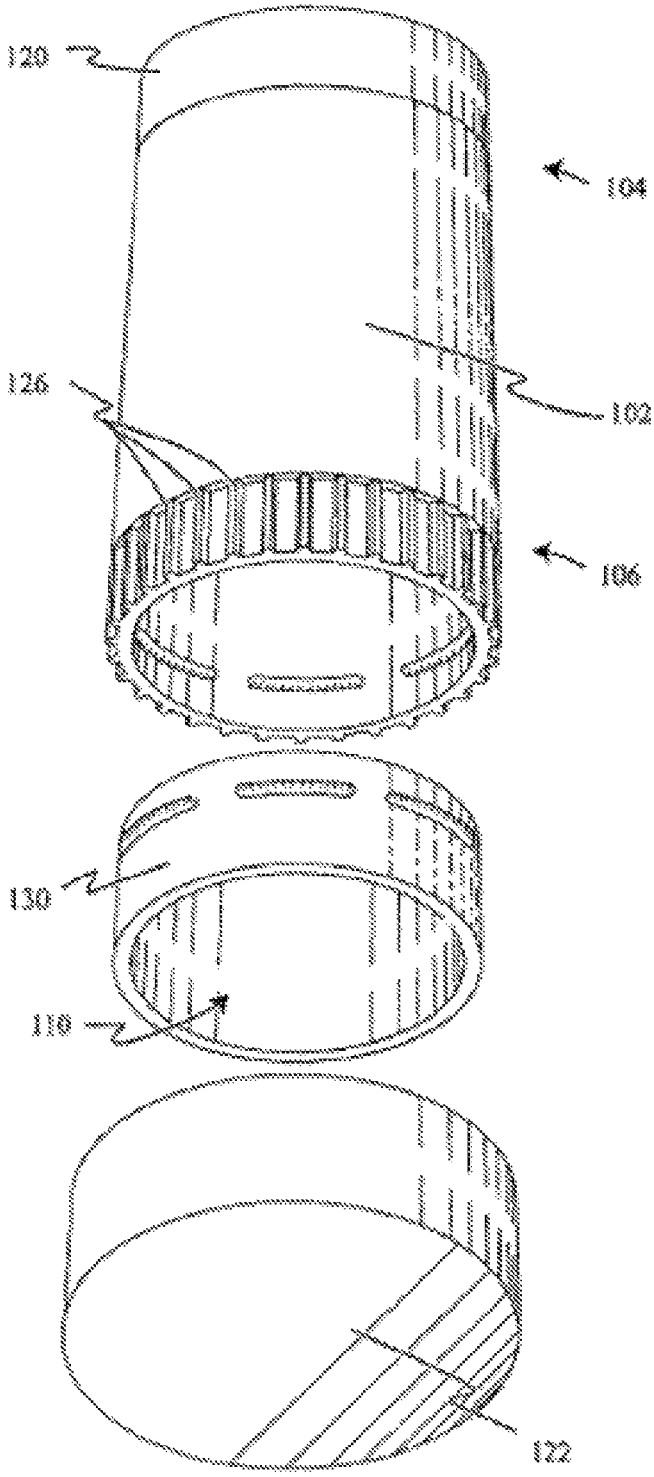
FIG. 4 is an angled view of an embodiment of the dual ended product container of the present invention, showing additional focus on the distal end, where the mechanism is a dial-and-screw type mechanism, where the second compartment is detachable from the elongate member.

Referring now to FIG. 4, in an alternate embodiment, the second compartment 110 is removable from the elongate member 102 and comprises a housing 130. In such an embodiment, the second compartment 110 need not be disproportionately less in volume than the first compartment 108. When removably attached to the elongate member 102, the second compartment 110 may be oriented in such a manner that the opening of the distal end is housed within a secondary cap 122, where the secondary cap is in physical alignment with the base of the elongate member, or the second compartment may be oriented such that a secondary cap is located distal from the end of the elongate member and is distinguished from the base of the elongate member. In this embodiment, the housing and the distal end of the elongate member together comprise a complimentary removably interlocking mechanism for removably attaching the housing to the distal end of the elongate member. Such interlocking mechanism may include a notch and groove mechanism, a threaded mechanism, or any other type of suitable mechanism known to those of ordinary skill in the art. Advantages seen in this embodiment include enabling the user to interchange the secondary product, including preferably between a secondary product that is identical to the primary product for use by others and a secondary product that is distinct from the primary product for use by the user, as well as other advantages. FIG. 4 shows an embodiment of a notch and groove type interlocking mechanism and further details the alignment of the secondary cap with the distal end of the elongate member.

In an embodiment, the second compartment may be a cylinder of greater or lesser radius than that of the first compartment or the elongate member, or the second compartment may be frustral in shape.

Figure 5A:
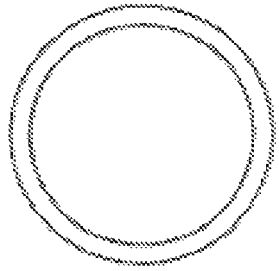
FIG. 5A is a cross-sectional view of the embodiment in FIG. 7, along line B-B.
Figure 5B:
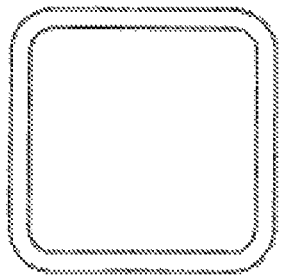
FIG. 5B and FIG. 5C are non-limiting embodiments of cross-sectional views, alternative to the view shown in FIG. 5A.
Figure 5C:
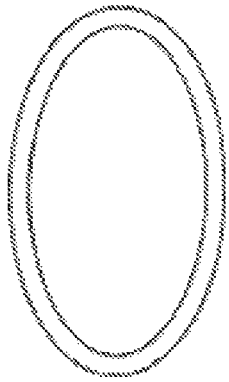

The face of the elongate member 102 is preferably circular so as to form a cylinder, though the face of the elongate member may be of other suitable shapes, such as a square or an oval or any other conventional shape known to those of ordinary skill in the art, such as those seen in non-limiting examples detailed in FIG. 5A, 5B, and 5C.

All references, including without limitation all papers, publications, presentations, texts, reports, manuscripts, brochures, internet postings, journal articles, periodical, and the like, cited in the specification are herby incorporated by reference. The discussion of the references herein is intended merely to summarize the assertions made by their authors and no admission is made that any references constitutes prior art. The inventors reserve the right to challenge the accuracy and pertinence of the cited references.

In view of the above, it will be seen that the several advantages of the invention are achieved and other advantageous results obtained. It should be understood that the aforementioned embodiments are for exemplary purposes only and are merely illustrative of the many possible specific embodiments that can represent application of the principles of the invention. Thus, as various changes could be made in the above methods and compositions without departing from the scope of the invention, it is intended that all matter contained in the above description as shown in the accompanying drawings shall be interpreted as illustrative and not in a limiting sense. Moreover, one of ordinary skill in the art can make various changes and modification to the invention to adapt it to various usages and conditions, including those not specifically laid out herein, without departing from the spirit and scope of this invention. Accordingly, those changes and modifications are properly, equitably, and intended to be, within the full range of equivalents of the invention disclosed and described herein.

The invention claimed is:

1. A dual-supply container, comprising:

a first compartment having a first internal volume and a first opening located at a first end of the first compartment, the first compartment comprising a platform positioned and displaceable within the first compartment and further comprising a mechanism for moving the platform in the first compartment;

a second compartment aligned with the first compartment, the second compartment having a second internal volume and a second opening facing outwardly in an opposite direction from the first opening, the second compartment including a longitudinally stationary base and a peripheral wall;

a first cover that covers the first opening of the first compartment; and a second cover that covers the second opening of the second compartment.

2. A container as set forth in claim 1 wherein the container is generally cylindrical about an axis, the first compartment is a first generally tubular housing and the second compartment is a second generally tubular housing.

3. A container as set forth in claim 1 wherein the platform in the first compartment is coaxially positioned and longitudinally displaceable within the first compartment.

4. A container as set forth in claim 1 wherein the second internal volume is smaller than the first internal volume.

5. A container as set forth in claim 2, further comprising a dial located at a second end of the first compartment, the second end opposite the first opening, the platform being movably axially by rotation of the dial relative to the axis.

6. A container as set forth in claim 5 wherein the second compartment includes the dial.

7. A container as set forth in claim 4 wherein the first internal volume is at least about 2 ml.

8. A container as set forth in claim 4 wherein the second internal volume is at most about 0.25 ml.

9. A container as set forth in claim 1 wherein the second compartment is releasably attached to the first compartment.

10. A container comprising:

a first compartment having a first opening and a first internal volume containing a first amount of a first product for direct application of the product through the first opening, the first compartment comprising a platform on which a multiple-use amount of the first product is seated, the platform coaxially positioned and longitudinally displaceable within the first compartment by rotating a dial;

a second compartment coaxially aligned with the first compartment, the second compartment having a second opening and a second internal volume defined by a cavity in the dial, the second internal volume smaller than the first internal volume and containing a stationary base and a second amount of a second product for direct application of the second product through the second opening; and a first removable cover that covers the first opening of the first compartment to seal the product in the first compartment, the first removable cover enclosing the first opening of the first compartment using an interference fit, and a second removable cover that covers the second opening of the second compartment to seal the product in the second compartment, the second removable cover attached to the second compartment by a hinge.

11. A container as set forth in claim 10 wherein the container is generally cylindrical about an axis, the first compartment is a first generally tubular housing oriented about the axis and the second compartment is a second generally tubular housing oriented about the axis.

12. A container as set forth in claim 11 wherein the openings of the compartments face outwardly in opposite directions from each other.

13. A container as set forth in claim 10 wherein the first amount is a multiple-use amount of at least about 2 ml and the second amount is a limited-use amount less than the multiple-use amount, and wherein the first product is the same as the second product.

14. A container as set forth in claim 10 wherein the limited-use amount is at most about 0.25 ml.

15. A container as set forth in claim 14 wherein the limited-use amount is at most about 0.1 ml.

16. A container as set forth in claim 11 wherein the second compartment is releasably attached to the first compartment.

17. A dual-supply container, comprising:

a first means for holding a first volume of a first product, the first means for holding the product comprising a means for supporting and dispensing the first product from the means for holding the product, and a means for moving the means for supporting and dispensing the first product;

a second means for holding a second volume of a second product operably attached to the first means for holding of the first product, and a means for accepting the second product longitudinally stationary in the second compartment;

a first means for covering the first volume of the first product; and a second means for covering the second volume of the second product.

18. A dual-supply container of claim 17 wherein the second internal volume of the second means for holding the second product is smaller than the first internal volume of the first means for holding the first product.

19. A dual-supply container of claim 17 wherein the means for accepting the first product is displaceable within the first compartment by rotation.

20. A dual-supply container of claim 18 wherein the first product and the second product are selected from the group consisting of a lip balm, a lip gloss and a lipstick.

* * * * *